US008311428B2

(12) United States Patent
Fuchimoto

(10) Patent No.: US 8,311,428 B2
(45) Date of Patent: Nov. 13, 2012

(54) IMAGE FORMING APPARATUS WITH DENSITY CORRECTION FUNCTION AND DENSITY CORRECTION METHOD

(75) Inventor: Nobuyuki Fuchimoto, Osaka (JP)

(73) Assignee: Kyocera Mita Corporation (JP)

( * ) Notice: Subject to any disclaimer, the term of this patent is extended or adjusted under 35 U.S.C. 154(b) by 310 days.

(21) Appl. No.: 12/848,463

(22) Filed: Aug. 2, 2010

(65) Prior Publication Data

US 2011/0033196 A1 Feb. 10, 2011

(30) Foreign Application Priority Data

Aug. 6, 2009 (JP) ..... 2009-183601

(51) Int. Cl.
*G03G 15/04* (2006.01)
*G03G 15/00* (2006.01)
*G03G 15/043* (2006.01)
*G03G 15/06* (2006.01)

(52) U.S. Cl. ..... 399/49; 399/32; 399/51; 399/55; 399/72

(58) Field of Classification Search ..... 399/32, 399/49, 51, 55, 72
See application file for complete search history.

(56) References Cited

U.S. PATENT DOCUMENTS 5,995,775 A * 11/1999 Budnik et al. ..... 399/31
7,466,464 B2 * 12/2008 Nakane et al. ..... 358/521

FOREIGN PATENT DOCUMENTS

JP 2008-292922 12/2008

* cited by examiner

*Primary Examiner* — Joseph S Wong
(74) *Attorney, Agent, or Firm* — Gerald E. Hespos; Michael J. Porco

(57) ABSTRACT

An image forming apparatus with a correction function for correcting density of an image, including: an image bearing member configured to convey the image in a first direction; and a controller configured to perform a bias correction and a γ correction for the density, wherein the controller includes: a test patch generator configured to generate on the image bearing member a test patch including a first test patch and a second test patch; a first density sensor configured to detect density of the first test patch; a second density sensor configured to detect density of the second test patch; a selector configured to select one of a first detection signal from the first density sensor and a second detection signal from the second density sensor as a bias-correction detection signal and another detection signal as a γ-correction detection signal.

14 Claims, 4 Drawing Sheets

IMAGE FORMING APPARATUS WITH DENSITY CORRECTION FUNCTION AND DENSITY CORRECTION METHOD

BACKGROUND OF THE INVENTION

1. Field of the Invention

The present invention relates to an image forming apparatus and a density correction method for correcting density of an image.

2. Description of the Related Art

Many types of image forming apparatuses form a full color image by superimposing a magenta image formed with a developer with a magenta hue, a yellow image formed with a developer with a yellow hue, a cyan image formed with a developer with a cyan hue and a black image formed with a developer with a black hue. A specific image forming apparatus corrects changes over time in density of developer. For example, the density is corrected using a toner patch formed on a photoconductive drum.

The specific image forming apparatus includes a transfer belt on which the toner patch for density correction is formed. FIG. 4 schematically shows the transfer belt of the specific image forming apparatus.

The transfer belt 1 shown in FIG. 4 includes a first edge portion 1*a* and a second edge portion 1*b* which extend in a moving direction of the transfer belt 1.

A test patch 2 for density correction is formed along the first edge portion 1*a*. The density correction using the test patch 2 is accomplished by a correction of a developing bias (bias calibration). A test patch 3 for density correction is formed along the second edge portion 1*b*. The density correction using the test patch 3 is accomplished by feeding an output density back to an input density to perform a γ correction (IO calibration).

The bias calibration and the IO calibration are performed using a density sensor 4 configured to detect density of the test patch 2 and a density sensor 5 configured to detect density of the test patch 3. As shown in FIG. 4, the density sensor 4 detects the density of the test patch 2 before the density sensor 5 detects the density of the test patch 3. A detection result from the density sensor 4 is fed back to the density detection of the test patch 3 by the density sensor 5. Thus, the detection accuracy of the test patch 3 by the density sensor 5 is improved.

Successive toner supply in a main scanning direction in the aforementioned image forming apparatus is likely to cause toner density variation between a first end edge of the transfer belt 1 where the toner supply starts and a second end edge of the transfer belt 1 where the toner supply ends, originated from variation in sensitivity of the photoconductive drum. Unless the density sensors detect any density variation in the main scanning direction, the density of the image largely deviates from target value, which in turn particularly leads to outstanding lower density.

SUMMARY OF THE INVENTION

An object of the present invention is to provide an image forming apparatus and a density correction method for performing a density correction less susceptible to density variation.

One aspect of the present invention is directed to an image forming apparatus with a correction function for correcting density of an image, including an image bearing member configured to convey the image in a first direction while bearing the image; and a controller configured to perform a bias correction and a γ correction for the density, wherein: the controller includes: a test patch generator configured to generate a test patch on the image bearing member, the test patch including a first test patch and a second test patch; a first density sensor configured to detect density of the first test patch to output a first detection signal corresponding to the density of the first test patch; a second density sensor configured to detect density of the second test patch to output a second detection signal corresponding to the density of the second test patch; a selector configured to compare the first detection signal with the second detection signal to select one of the first detection signal and the second detection signal as a bias-correction detection signal used for the bias correction while selecting another detection signal as a γ-correction detection signal used for the γ correction; and an adjuster configured to adjust the density by performing the bias correction based on the one detection signal and the γ correction based on the other detection signal, and the image bearing member bears the first and second test patches at positions separated in a second direction intersecting with the first direction.

Another aspect of the present invention is directed to a method for correcting density of an image, including a step of generating a test patch on an image bearing member configured to move in a first direction, the test patch including a first test patch and a second test patch; a step of detecting densities of the first and second test patches, respectively; and a step of performing a bias correction and a γ correction based on a comparison between the density of the first test patch and that of the second test patch, wherein the step of generating the test patch includes a step of generating the first and second test patches at positions separated in a second direction intersecting with the first direction.

DETAILED DESCRIPTION OF THE PREFERRED EMBODIMENTS

Hereinafter, one embodiment according to the present invention is described with reference to the drawings. Direction-indicating terms such as "upper", "lower", "left" and "right" are merely used in the following description for the purpose of clarifying the description and should not be interpreted in any limited manner. A term "sheet" used in the following description means a copy sheet, tracing paper, a cardboard, an OHP sheet or another sheet on which an image may be formed.

(Mechanical Configuration of the Image Forming Apparatus)

Figure 1:
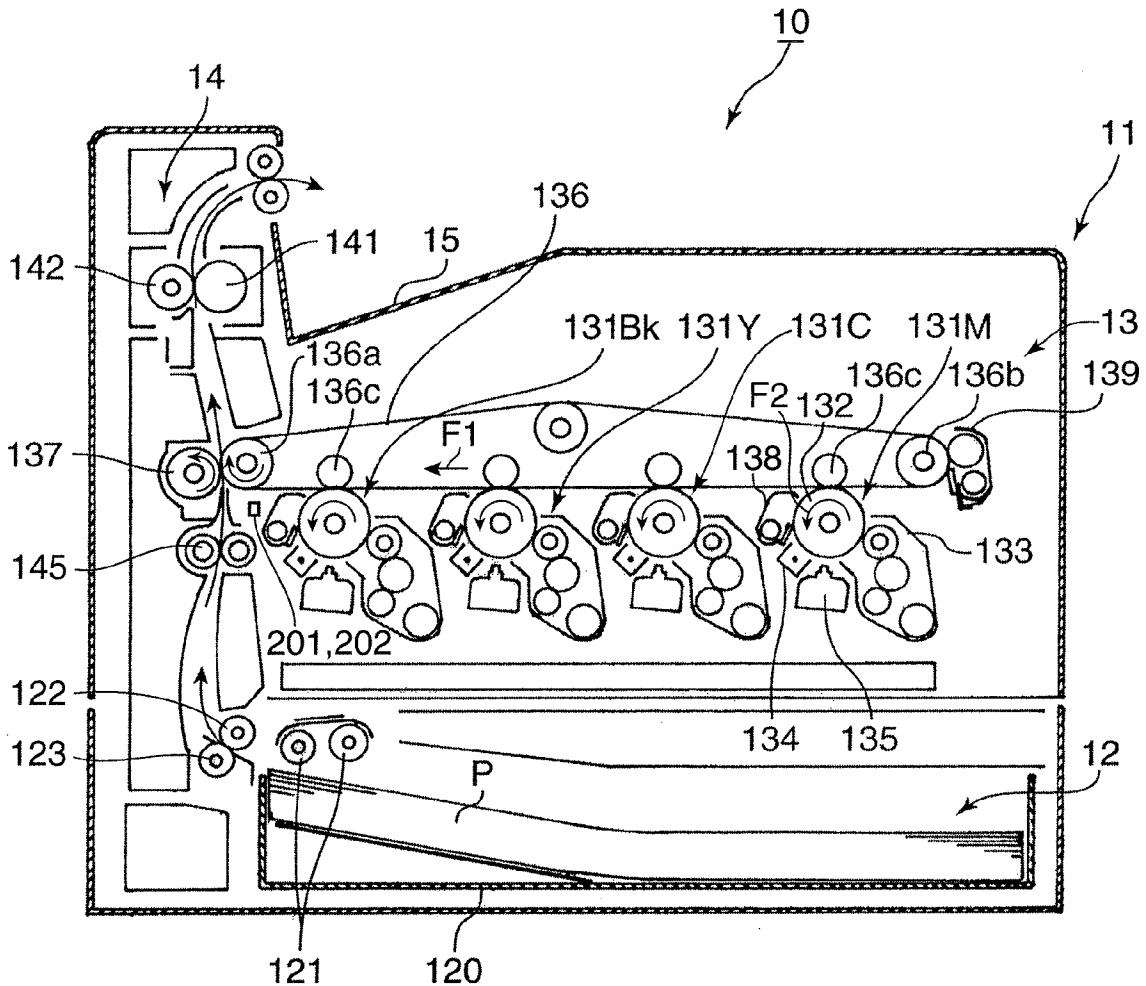
FIG. 1 is a schematic diagram showing a configuration of an image forming apparatus according to one embodiment of the invention.

FIG. 1 is a schematic diagram showing a configuration of an image forming apparatus. The image forming apparatus shown in FIG. 1 is a tandem printer. Alternatively, an MFP, a copier or a facsimile machine other than the tandem printer may be used as an image forming apparatus configured to form a toner image on a sheet.

The image forming apparatus 10 configured to electrophotographically form an image includes an image forming unit 131M configured to form a toner image with a magenta hue, an image forming unit 131C configured to form a toner image with a cyan hue, an image forming unit 131Y configured to form a toner image with a yellow hue and an image forming unit 131Bk configured to form a toner image with a black hue.

The image forming apparatus 10 further includes a transfer belt 136. The image forming units 131M, 131C, 131Y and 131Bk transfer the toner images with the respective hues to an outer circumferential surface of the transfer belt 136. The toner images of the respective hues from the image forming units 131M, 131C, 131Y and 131Bk are superimposed on the transfer belt 136 to form a full color toner image (primary transfer).

The image forming apparatus 10 further includes a sheet cassette 120 configured to accommodate a sheet P and a secondary transfer roller 137. The sheet P in the sheet cassette 120 is conveyed toward the secondary transfer roller 137. The secondary transfer roller 137 transfers the full color toner image from the transfer belt 136 to the sheet P (secondary transfer).

The image forming unit 131M is disposed at a most upstream side in a conveying direction F1 of the transfer belt 136. The image forming unit 131Bk is disposed at a most downstream side in the conveying direction F1 of the transfer belt 136. The image forming unit 131Y is disposed between the image forming unit 131Bk and the image forming unit 131C adjacent to the image forming unit 131M. The positional relationship among the image forming units 131M, 131C, 131Y and 131Bk may be appropriately determined according to image forming speeds of the respective image forming units 131M, 131C, 131Y and 131Bk and a running speed of the transfer belt 136.

Each of the image forming units 131M, 131C, 131Y and 131Bk includes a photoconductive drum 132, a cleaning device 138, a charger 134, an exposure device 135, a developing device 133 and a primary transfer roller 136*c*. The cleaning device 138, the charger 134, the exposure device 135, the developing device 133 and the primary transfer roller 136*c* are successively arranged to surround the photoconductive drum 132 in a rotating direction F2 of the photoconductive drum 132.

The cleaning device 138 removes toner residual on the circumferential surface of the photoconductive drum 132. The circumferential surface of the photoconductive drum 132 cleaned by the cleaning device 138 heads for the charger 134. The charger 134 uniformly charges the cleaned circumferential surface of the photoconductive drum 132. The circumferential surface of the photoconductive drum 132 charged by the charger 134 passes the exposure device 135. Meanwhile, the exposure device 135 irradiates abeam in accordance with image data. As a result, an electrostatic latent image in conformity with the image data is formed on the circumferential surface of the photoconductive drum 132. It should be noted that the image data may be supplied, for example, from a personal computer electrically connected to the image forming apparatus 10 or another apparatus configured to generate or transmit the image data.

The exposure device 135 scans the beam in a direction parallel with a rotational axis of the photoconductive drum 132 in accordance with the image data. Accordingly, in this embodiment, the direction parallel with the rotational axis of the photoconductive drum 132 is called a main scanning direction. Further, a direction parallel with the rotating direction of the photoconductive drum 132 and/or the moving direction of the transfer belt 136 is called a sub scanning direction.

The circumferential surface of the photoconductive drum 132 on which the electrostatic latent image is formed heads for the developing device 133. The developing device 133 supplies the toner to the circumferential surface of the photoconductive drum 132. As a result, the electrostatic latent image on the circumferential surface of the photoconductive drum 132 is developed into a toner image. Thereafter the circumferential surface of the photoconductive drum 132 heads for the primary transfer roller 136*c* while bearing the toner image. The primary transfer roller 136*c* transfers the toner image from the circumferential surface of the photoconductive drum 132 to the transfer belt 136.

The image forming apparatus 10 further includes a drive roller 136*a* configured to cause the transfer belt 136 to run and an idler roller 136*b* configured to rotate as the transfer belt 136 runs. The transfer belt 136 mounted between the drive roller 136*a* and the idler roller 136*b* runs above the image forming units 131M, 131C, 131Y and 131Bk. The primary transfer rollers 136*c* successively transfer the toner images with the magenta hue, the cyan hue, the yellow hue and the black hue to the outer circumferential surface of the transfer belt 136 held in contact with the circumferential surfaces of the photoconductive drums 132. As a result, the full color toner image is formed on the outer circumferential surface of the transfer belt 136 by superimposing the toner images with the magenta hue, the cyan hue, the yellow hue and the black hue. The transfer belt 136 is conveyed in the direction indicated by an arrow F1 while bearing the full color toner image. The direction (sub scanning direction) indicated by the arrow F1 in FIG. 1 is exemplified as a first direction. A direction orthogonal to the first direction (i.e. width direction of the transfer belt 136) is exemplified as a second direction. The transfer belt 136 is exemplified as an image bearing member in this embodiment.

The image forming apparatus 10 further includes a cleaning device 139 adjacent to the idler roller 136*b*. The cleaning device 139 removes the toner residual on the outer circumferential surface of the transfer belt 136 after the transfer of the full color toner image to the sheet P (second transfer).

The image forming apparatus 10 further includes a sheet feeder 12. The sheet feeder 12 includes a pickup roller 121 in addition to the aforementioned sheet cassette 120. When the pickup roller 121 disposed above the left ends (in FIG. 1) of the sheet P in the sheet cassette 120 is rotated, the sheet P is taken out from the sheet cassette 120.

The sheet feeder 12 includes a feed roller 122 and a separation roller 123. The pickup roller 121 feeds the sheet P to a nip between the feed roller 122 and the separation roller 123. The feed roller 122 is so rotated as to convey the sheet P further downstream. The separation roller 123 is so rotated as to return the sheet P to the sheet cassette 120. If the pickup roller 121 simultaneously feeds sheets P, the separation roller 123 returns to the sheet cassette 120 all the sheets P except the one directly in contact with the feed roller 122. On the other hand, the sheet P directly in contact with the feed roller 122 is conveyed further downstream as the feed roller 122 is rotated. In this way, the sheets P are conveyed one by one toward the secondary transfer roller 127.

The image forming apparatus 10 further includes registration rollers 145 arranged in a conveyance path defined between the feed roller 122 and the secondary transfer roller 137. The registration rollers 145 adjust a conveyance timing of the sheet P so that the full color toner image on the transfer belt 136 is transferred to a proper position of the sheet P. Thus, the full color toner image on the transfer belt 136 is secondarily transferred to the proper position of the sheet P reached a nip portion defined between the secondary transfer roller 137 and the drive roller 136*a*.

The image forming apparatus 10 further includes a fixing device 14 configured to fix the full color toner image transferred to the sheet P in the nip portion defined between the secondary transfer roller 137 and the drive roller 136*a*. The fixing device 14 includes a heat roller 141 heated by an electric heating element and a pressure roller 142 configured to press the sheet P into contact with the heat roller 141. The full color toner image to be fixed on the sheet P passing between the heat roller 141 and the pressure roller 142 is subject to heat energy from the heat roller 141.

The image forming apparatus 10 further includes a discharger 15. The sheet P after the fixation of the toner image by the fixing device 14 is discharged from the image forming apparatus 10 by the discharger 15.

One of the image forming units 131M, 131C, 131Y and 131Bk of the above image forming apparatus 10 is exemplified as a first image forming unit and another one thereof is exemplified as a second image forming unit. A toner image formed by the image forming unit exemplified as the first image forming unit is exemplified as a first image. A toner image formed by the image forming unit exemplified as the second image forming unit is exemplified as a second image. In addition, a full color toner image formed on the transfer belt 136 by the image forming units 131M, 131C, 131Y and 131Bk is exemplified as an image formed by superimposing the first and second images.

The photoconductive drum 132 of the image forming unit exemplified as the first image forming unit is exemplified as a first photoconductive drum. The photoconductive drum 132 of the image forming unit exemplified as the second image forming unit is exemplified as a second photoconductive drum.

The circumferential surface of the photoconductive drum 132, which is exemplified as the first photoconductive drum, is exemplified as a first circumferential surface. The circumferential surface of the photoconductive drum 132, which is exemplified as the second photoconductive drum, is exemplified as a second circumferential surface.

The developing device 133 configured to supply the toner to the circumferential surface of the photoconductive drum 132 exemplified as the first photoconductive drum is exemplified as a first developing device. Further, the toner supplied by the developing device 133 exemplified as the first developing device is exemplified as a first developer and/or a first toner. The developing device 133 configured to supply the toner to the circumferential surface of the photoconductive drum 132 exemplified as the second photoconductive drum is exemplified as a second developing device. Further, the toner supplied by the developing device 133 exemplified as the second developing device is exemplified as a second developer and/or a second toner.

The hue of the toner exemplified as the first developer and/or the first toner is exemplified as a first hue. The hue of the toner exemplified as the second developer and/or the second toner is exemplified as a second hue.

(Formation of Test Patch)

Figure 2A:
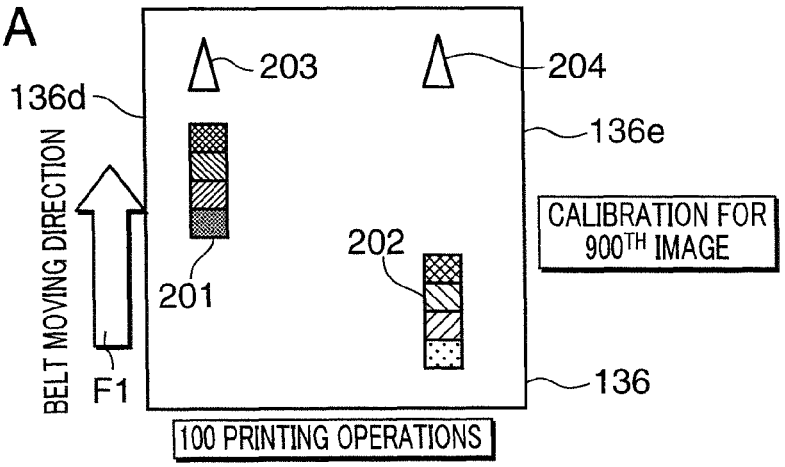
FIGS. 2A to 2C are diagrams schematically showing a bias correction and a γ correction performed by the image forming apparatus shown in FIG. 1.
Figure 2B:
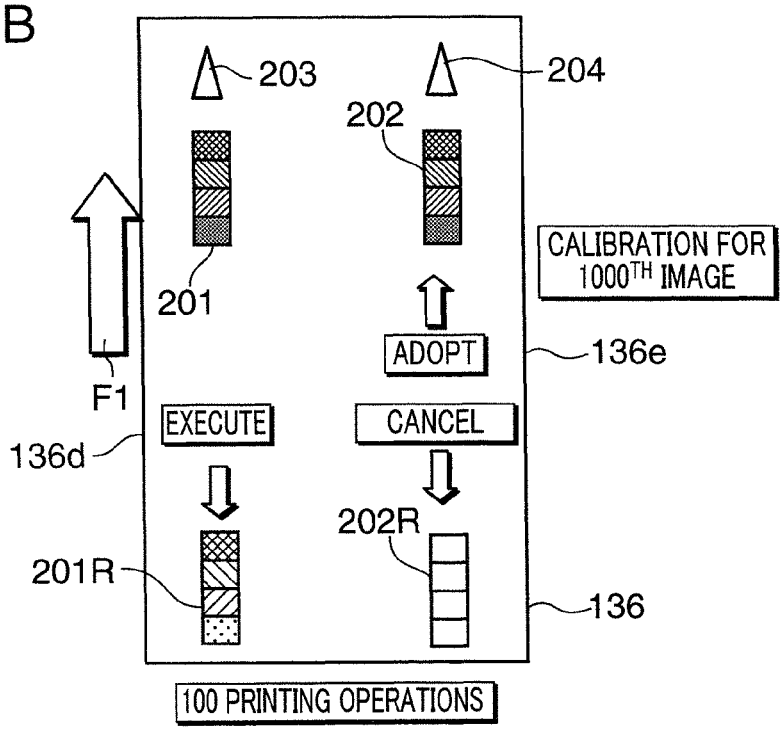
Figure 2C:
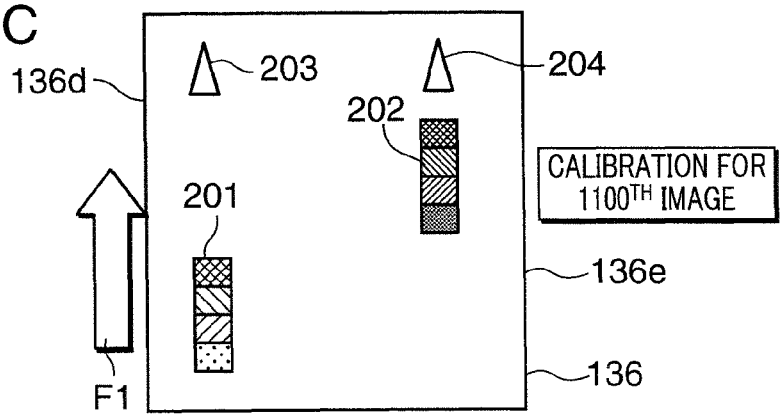

FIGS. 2A to 2C show a test patch formed on the transfer belt 136. FIG. 2A shows the test patch formed when the $900^{th}$ image is formed. FIG. 2B shows the test patch formed when the $1000^{th}$ image is formed. FIG. 2C shows the test patch formed when the $1100^{th}$ image is formed. The formation of the test patch is described with reference to FIGS. 1, 2A to 2C and 4.

In this embodiment, the image forming units 131M, 131C, 131Y and 131Bk operate together to form a first test patch 201 and a second test patch 202 using the toners. The first and second test patches 201, 202 are formed, for example, per 100 times of the image formation. The first and second test patches 201, 202 maybe formed, for example, when the $100^{th}$, $200^{th}$, . . . , or N×100 (N is a natural number) image is formed.

The transfer belt 136 includes a first edge portion 136*d* and a second edge portion 136*e* which extend in the moving direction of the transfer belt 136. The image forming units 131M, 131C, 131Y and 131Bk form the first test patch 201 near the first edge portion 136*d*. The image forming units 131M, 131C, 131Y and 131Bk also form the second test patch 202 near the second edge portion 136*e*. The second test patch 202 is formed at a position separated from the first test patch 201 in the main scanning direction. The first and second test patches 201, 202 extend in the sub scanning direction.

The image forming apparatus 10 further includes a first density sensor 203 configured to detect density of the first test patch 201 and a second density sensor 204 configured to detect density of the second test patch 202. One of a detection result of the first test patch 201 from the first density sensor 203 and that of the second test patch 202 from the second density sensor 204 is used for the bias correction, and another is used for the γ correction. It is conducted, for example, whenever the $1000^{th}$ image is formed, to determine the detection result to be used for the bias correction or the γ correction. For example, it is carried out at the $1000^{th}$, $2000^{th}$, . . . , and $M\times1000^{th}$ (M is a natural number) of the image formation to determine the detection result to be used for the bias correction or the γ correction.

The bias correction is performed to reduce a difference between a target value determined for the test patch (the first test patch 201 and/or the second test patch 202) and the density of the first test patch 201 or the second test patch 202 detected by the first or second density sensor 203 or 204. In this embodiment, the bias correction is performed through change in bias voltage of the developing device 133. The γ correction is performed to reduce density mottle of the first test patch 201 or second test patch 202. The γ correction is accomplished, for example, by feeding an output density detected by the first or second density sensor 203 or 204 back to input density to the developing device 133. As a result of the bias correction and the γ correction, a suitable image with a given density and less density mottle is formed. Various known methods may be used for the bias correction and the γ correction.

As shown in FIG. 2A, the first test patch 201 formed on the transfer belt 136 precedes the second test patch 202 when the $900^{th}$ image is formed. At this time, a detection result of the first test patch 201 from the first density sensor 203 is used for the bias correction. As a result, the detection result of the first test patch 201 is reflected on (fed back to) the density of the subsequent second test patch 202. Thus, the second test patch to which the bias correction has applied is formed.

As shown in FIG. 2B, the first test patch 201 is formed on the transfer belt 136 substantially simultaneously with the second test patch 202 when the $1000^{th}$ image is formed. Both of a detection result of the first test patch 201 from the first density sensor 203 and that of the second test patch 202 from the second density sensor 204 are compared with a target value determined for the density of the test patch (the first and second test patches). The detection result more largely deviating from the target value from one of the first density sensor 203 for the first test patch 201 and the second density sensor 204 for the second test patch 202 is used for the bias correction. One of the first test patch 201 and the second test patch 202, of which density is less deviated from the target value, is formed again on the transfer belt 136. In FIG. 2B it is shown that the detection result from the first density sensor 203 for the first test patch 201 is closer to the target value. In FIG. 2B, the first test patch formed again is denoted by "201R".

The first density sensor 203 detects the reformed first test patch 201R. A detection result from the first density sensor 203 for the reformed first test patch 201R is used for the γ correction. If a second test patch 202R is reformed, a detection result from the second density sensor 204 for the second test patch 202R is used for the γ correction.

As shown in FIG. 2C, the second test patch 202 including density more largely deviating from the target value at the time of the $1000^{th}$ image formation precedes the first test patch 201 on the transfer belt 136 at the time of the $1100^{th}$ image formation. A detection result from the second density sensor 204 for the second test patch 202 is used for the bias correction. A detection result from the first density sensor 203 for the first test patch 201 is used for the γ correction. Thereafter, formation of the second test patch 202 precedes formation of the first test patch 201 until the $1900^{th}$ image formation.

If it is figured out that the density in the first test patch 201 more largely deviates from the target value at the time of forming the $1000^{th}$ image, the formation of the first test patch 201 precedes the formation of the second test patch 202, as at the time of forming the $900^{th}$ image.

In this way, the formation of the first and second test patches 201, 202 after the aforementioned determination is methodized based on the determination result per $1{,}000^{th}$ image formation. A detection result of a preceding test patch after the aforementioned determination is used for the bias correction while a detection result of a subsequent test patch is used for the γ correction.

Figure 4:
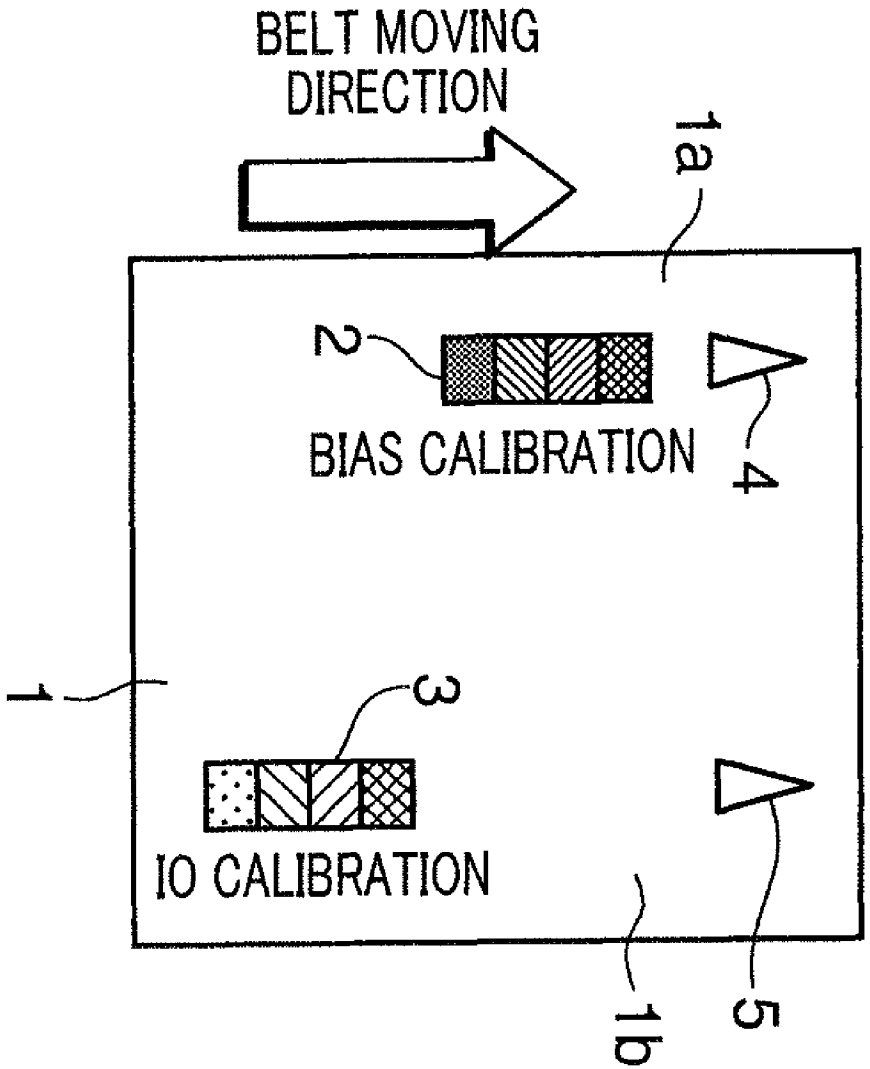
FIG. 4 is a diagram schematically showing a conventional density correction.

It results in less susceptible bias correction and γ correction to a density variation in the main scanning direction to define the test patch used for the bias correction and that used for the γ correction based on the determination result effected in a given image formation cycle as compared with a method for fixedly defining the test patch used for the bias correction and that used for the γ correction (see FIG. 4). In this embodiment, the bias correction is properly performed using the detection result of the test patch more largely deviating from the target value. Further, as a result of the γ correction using the properly bias-corrected test patch, an image with less density mottle is properly formed.

(Electrical Configuration of the Image Forming Apparatus)

Figure 3:
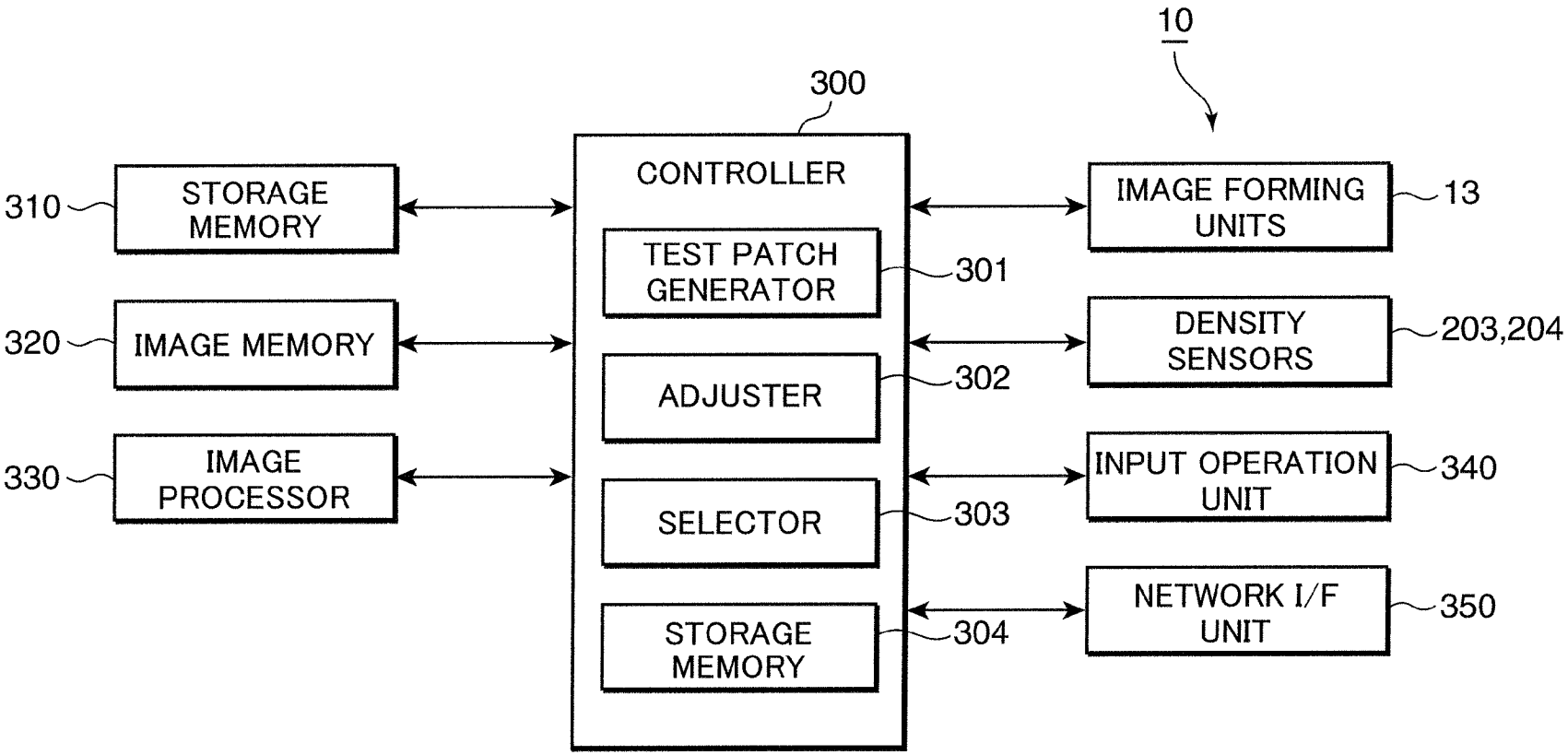
FIG. 3 is a block diagram showing an electrical configuration of the image forming apparatus shown in FIG. 1.

FIG. 3 is a block diagram showing an electrical configuration of the image forming apparatus 10. The calibration described with reference to FIGS. 2A to 2C (bias correction and γ correction) are described with reference to FIGS. 1 to 3.

The image forming apparatus 10 includes a controller 300, a storage memory 310, an image memory 320, an image processor 330, an input operation unit 340 and a network I/F unit 350 in addition to the image forming units 13, the first density sensor 203 and the second density sensor 204.

Various programs for controlling operations performed by the image forming apparatus 10 are stored in the storage memory 310. The image memory 320 temporarily stores the image data transmitted from an external apparatus (e.g. personal computer) via the network I/F unit 350. The network I/F unit 350 may be a communication module such as a LAN board. The network I/F unit 350 communicates necessary data with the external apparatus via a network (not shown) connected with the network I/F unit 350.

The image processor 330 performs an image correction, an enlargement processing, a reduction processing and other desired image processes to the image data stored in the image memory 320. The input operation unit 340 includes, for example, a power key and setting keys. A user may cause the image forming apparatus 10 to perform a given process through the input operation unit 340.

The controller 300 includes, for example, a CPU (Central Processing Unit) and peripheral circuits. The controller 300 reads the program stored in the storage memory 310 to perform a process according to the program. The controller 300 outputs or transmits instruction signals or data to various elements in the image forming apparatus 10. Thus, the controller 300 totally controls the image forming apparatus 10.

The controller 300 performs the bias correction and the γ correction for the density of the toner image. The controller 300 includes a test patch generator 301, an adjuster 302, a selector 303 and a storage memory 304 which are used for the bias correction and the γ correction.

The test patch generator 301 outputs a control signal for generating the test patch (the first and second test patches 201, 202) to the image forming unit 13 every the $100^{th}$ image formation. The image forming unit 13 forms the test patch (the first and second test patches 201, 202) on the transfer belt 136 using the toner with the magenta hue, the cyan hue, the yellow hue or the black hue. If the comparison between the density of the test patch and the target value described in the context of FIG. 2A is not performed at all, according to a default setting, the test patch generator 301 may determine one of the first and second test patches 201, 202 as the preceding test patch (i.e. test patch for the bias correction) and the other as the subsequent test patch (i.e. test patch for the γ correction).

As shown in FIGS. 2A to 2C, each of the first and second test patches 201, 202 preferably includes rectangular areas formed by the toners with the magenta hue, the cyan hue, the yellow hue and the black hue, respectively. These four rectangular areas are aligned in the sub scanning direction.

Each of the first and second density sensors 203, 204 outputs a detection signal corresponding to the respective densities of these four rectangular areas. In this embodiment, the detection signal output from the first density sensor 203 corresponding to the first test patch 201 is exemplified as a first detection signal and that output from the second density sensor 204 corresponding to the second test patch 202 is exemplified as a second detection signal.

The storage memory 304 in advance stores data indicating a relationship between the detection signals from the first and second density sensors 203, 204 and the density (e.g. toner adherence amount) in the test patch (the first and second test patches 201, 202).

The storage memory 304 also stores a first table for the bias correction. The first table includes various parameters for the bias correction associated with the data indicating the relationship between the detection signals and the density.

The storage memory 304 further stores a second table used for the γ correction. The detection signals from the first and second density sensors 203, 204 are fed back to input signals to the developing device 133, so that output density from the developing device 133 is subject to the γ correction using the second table.

The storage memory 304 further stores the target value predetermined for the density of the test patch (the target values determined for the toners with the magenta hue, the cyan hue, the yellow hue and the black hue, respectively).

The adjustor 302 performs the bias correction (bias calibration) based on the first table and the output signal from the sensor (the first or second density sensor 203 or 204) after detection for the preceding test patch. After the bias correction, the subsequent test patch is formed. Thus, the density of the subsequent test patch is adjusted according to the target value. For example, if the output from the sensor after the detection for the preceding test patch indicates that the density of the preceding test patch is lower than the target value, the thicker subsequent test patch is formed than the preceding test patch.

The adjustor 302 performs the γ correction based on the output signal from the sensor (the first or second density sensor 203 or 204) after detection for the subsequent test patch.

The test patch generator 301 outputs a control signal for causing the image forming unit 13 to substantially simultaneously form the first and second test patches 201, 202 every the $1000^{th}$ image formation.

The selector 303 compares a difference between the target value and the density of the first test patch 201 detected by the first density sensor 203 with a difference between the target value and the density in the second test patch 202 detected by the second density sensor 204. The selector 303 further determines to use the detection result showing larger deviation from the target value for the bias correction and use the detection result showing smaller deviation from the target value for the γ correction.

The selector 303 may determine the difference between the density of the first or second test patch 201 or 202 detected by the first or second density sensor 203 or 204 and the target value, for example, by adding up the difference between the target value predetermined for the density of the toner with the magenta hue and the density of the toner in the rectangular area with the magenta hue, the difference between the target value predetermined for the density of the toner with the cyan hue and the density of the toner in the rectangular area with the cyan hue, the difference between the target value predetermined for the density of the toner with the yellow hue and the density of the toner in the rectangular area with the yellow hue and the difference between the target value predetermined for the density of the toner with the black hue and the density of the toner in the rectangular area with the black hue.

In this way, the selector 303 may select the test patch for the bias correction and that for the γ correction by comparing the first detection signal from the first density sensor 203 with the second detection signal from the second density sensor 204.

The adjuster 302 performs the bias correction using the detection result showing larger deviation from the target value. The test patch generator 301 forms again the test patch (the first or second test patch 201 or 202) giving the detection result which shows smaller deviation from the target value on the transfer belt 136. The result of the bias correction by the adjuster 302 may be reflected in the formation of the new test patch by the test patch generator 301.

The density of the new test patch is detected by the corresponding density sensor (the first or second density sensor 203 or 204). The adjuster 302 performs the γ correction based on a detection result from the new test patch.

When the $100^{th}$ image is formed thereafter, the test patch generator 301 forms on the transfer belt 136 the test patch (the first or second test patch 201or 202) identified by the selector 303 that the density more largely deviates from the target value. Thereafter, the test patch generator 301 forms on the transfer belt 136 the test patch identified by the selector 303 that the density less deviates from the target value.

The adjuster 302 performs the bias correction based on the detection signal from the density sensor measuring the density of the preceding test patch. The adjuster 302 performs the γ correction based on the detection signal from the density sensor measuring the density of the subsequent test patch.

The determination by the selector 303 is executed as described above, thereafter every time the $1000^{th}$ image is formed.

As described above, the selector 303 selects the test patch with the density closer to the density target value as the test patch for the γ correction. Thus, the γ correction less susceptible to the density variation in the main scanning direction is performed.

The principle of the above embodiment is particularly suitably applied to an image forming apparatus adopting an image forming configuration susceptible to density variation in the main scanning direction (e.g. an image forming apparatus including the developing device 133 configured to supply the toner in the main scanning direction).

The developing device 133 configured to supply the toner in the main scanning direction is likely to cause toner density variation between start position where the toner supply starts and an end position where the toner supply ends, originated from variation in sensitivity of the photoconductive drum 132. The principle according to the present embodiment provides a γ correction less susceptible to the density variation.

The formation of the test patch (the first and second test patches 201, 202) separated in the main scanning direction suitably contributes to less influence of the density variation in the main scanning direction on the γ correction.

In this embodiment, the transfer belt 136 is exemplified as the image bearing member. Alternatively, the photoconductive drums 132, the sheet P or another element configured to bear an image may be used as the image bearing member.

In the above description, the test patch are formed every the $100^{th}$ image formation. Alternatively, the test patch maybe formed in another period. The period for the test patch formation may be appropriately determined according to the performance of the image forming apparatus 10.

In the above description, the density determination by the selector 303 is executed every the $1000^{th}$ image formation. Alternatively, the density determination by the selector 303 may be executed in another period. The determination period by the selector 303 may be appropriately determined according to the performance of the image forming apparatus 10.

The bias correction method and the γ correction method based on the density of the detected test patch may follow the known methods. The selection between the test patch for the bias correction and that for the γ correction based on the above density determination by the selector 303 may provide more suitable bias correction and γ correction according to the known methods.

An image forming apparatus with a correction function for correcting the density of an image according to one aspect of the above embodiment includes an image bearing member configured to convey the image in a first direction while bearing the image; and a controller configured to perform a bias correction and a γ correction for the density, wherein the controller includes a test patch generator configured to generate a test patch on the image bearing member. The test patch includes a first test patch and a second test patch. The controller includes a first density sensor configured to detect density of the first test patch. The first density sensor outputs a first detection signal corresponding to the density of the first test patch. The controller includes a second density sensor configured to detect density of the second test patch. The second density sensor outputs a second detection signal corresponding to the density of the second test patch. The controller also includes a selector configured to compare the first and second detection signals to select one of the first and second detection signals as a bias-correction detection signal used for the bias correction while selecting another detection signal as a γ-correction detection signal used for the γ correction, and an adjuster configured to adjust the density by performing the bias correction based on the one detection signal and performing the γ correction based on the other detection signal, and the image bearing member bears the first and second test patches at positions separated in a second direction intersecting with the first direction.

According to the above configuration, the image forming apparatus with the correction function for correcting the density of the image includes the image bearing member configured to convey the image in the first direction while bearing the image, and the controller configured to perform the bias correction and the γ correction for the density of the image. The controller includes the test patch generator configured to generate the test patch on the image bearing member. The test patch includes the first and second test patches. The first density sensor detects the density of the first test patch. The second density sensor detects the density of the second test patch. The first density sensor outputs the first detection signal and the second density sensor outputs the second detection signal. The selector compares the first and second detection signals to select one of the first and second detection signals as the bias-correction detection signal used for the bias correction. Further, the selector selects the other detection signal as the γ-signal detection signal used for the γ correction. The adjuster performs the bias correction based on the one detection signal and the γ correction based on the other detection signal. The image bearing member bears the first and second test patches at the positions separated in the second direction intersecting with the first direction. Accordingly, even if the densities of the image vary in the second direction intersecting with the first direction in which the image bearing member conveys the image, the selector properly selects the detection signal used for the bias correction and that used for the γ correction. The adjuster performs the bias correction and the γ correction according to the selection of the detection signals by the selector. As a result, the density variation in the second direction is less likely to affect the bias correction and the γ correction.

In the above configuration, it is preferable that the controller performs the bias correction based on a target value determined for the density of the test patch; and that the selector selects the first detection signal as the one detection signal when a difference between the density of the first test patch and the target value is larger than a difference between the density of the second test patch and the target value while selecting the second detection signal as the one detection signal when the difference between the density of the first test patch and the target value is smaller than the difference between the density of the second test patch and the target value.

According to the above configuration, the bias correction is properly performed using the detection signal obtained from the test patch of which density more largely deviates from the target value.

In the above configuration, it is preferable that the controller performs the bias correction based on a target value determined for the density of the test patch; and that the selector selects the second detection signal as the other detection signal when a difference between the density of the first test patch and the target value is larger than a difference between the density of the second test patch and the target value while selecting the first detection signal as the other detection signal when the difference between the density of the first test patch and the target value is smaller than the difference between the density of the second test patch and the target value.

According to the above configuration, the γ correction is properly performed using the detection signal obtained from the test patch of which density less deviates from the target value.

In the above configuration, the test patch generator preferably causes the image bearing member to bear the first test patch before the second test patch if the selector selects the first detection signal as the one detection signal.

According to the above configuration, the test patch generator causes the image bearing member to bear the first test patch before the second test patch if the selector selects the first detection signal as the one detection signal. Thus, the first detection signal used for the bias correction is output earlier.

In the above configuration, the test patch generator preferably causes the image bearing member to bear the second test patch before the first test patch if the selector selects the second detection signal as the one detection signal.

According to the above configuration, the test patch generator causes the image bearing member to bear the second test patch before the first test patch if the selector selects the second detection signal as the one detection signal. Thus, the second detection signal used for the bias correction is output earlier.

In the above configuration, the image forming apparatus further includes an image forming unit configured to form the image. It is preferable that the image bearing member includes a transfer belt to which the image is transferred from the image forming unit; the selector performs the bias correction for the image forming unit based on the first detection signal so as to reduce the difference between the target value and the density of the first test patch; that the test patch generator causes the image forming unit after the bias correction to form a new second test patch on the transfer belt; that the second density sensor outputs a new second detection signal based on density of the new second test patch; and that the adjuster performs the γ correction based on the new second detection signal so as to reduce density mottle.

According to the above configuration, an image is formed on the transfer belt by the image forming unit. The selector performs the bias correction for the image forming unit based on the first detection signal so as to reduce the difference between the target value and the density of the first test patch. The test patch generator causes the image forming unit after the bias correction to form the new second test patch on the transfer belt. The second density sensor outputs the new second detection signal based on the density of the new second test patch. The adjuster performs the γ correction based on the new second detection signal so as to reduce the density mottle. Thus, the γ correction is properly performed.

In the above configuration, the image forming apparatus further includes an image forming unit configured to form the image. It is preferable that the image bearing member includes a transfer belt to which the image is transferred from the image forming unit; that the selector performs the bias correction for the image forming unit based on the second detection signal so as to reduce the difference between the target value and the density of the second test patch; that the test patch generator causes the image forming unit after the bias correction to form a new first test patch on the transfer belt; that the first density sensor outputs a new first detection signal based on density of the new first test patch; and that the adjuster performs the γ correction based on the new first detection signal so as to reduce density mottle.

According to the above configuration, an image is formed on the transfer belt by the image forming unit. The selector performs the bias correction for the image forming unit based on the second detection signal so as to reduce the difference between the target value and the density of the second test patch. The test patch generator causes the image forming unit after the bias correction to form the new first test patch on the transfer belt. The first density sensor outputs the new first detection signal based on the density of the new first test patch. The adjuster performs the γ correction based on the new first detection signal so as to reduce the density mottle. Thus, the γ correction is properly performed.

In the above configuration, the image forming apparatus further includes an image forming unit configured to form the image. It is preferable that the image includes a first image formed using a first developer with a first hue and a second image formed using a second developer with a second hue; that the image forming unit includes a first image forming unit configured to form the first image and a second image forming unit configured to form the second image; that the image bearing member includes a transfer belt to which the first image is transferred from the first image forming unit and the second image is transferred from the second image forming unit; that the first and second images are superimposed on the transfer belt; that the test patch generator causes the first and second image forming units to form the test patch on the transfer belt; that each of the first and second test patches includes a first hue area formed using the first developer and a second hue area formed using the second developer; and that the controller performs the bias correction and the γ correction for densities of the first and second hue areas.

According to the above configuration, the first image forming unit forms the first image. The second image forming unit forms the second image. The first and second images respectively transferred from the first and second image forming units are superimposed on the transfer belt. The first and second images with the densities properly adjusted by the bias correction and the γ correction which are less susceptive to the density variation in the second direction as described above are properly superimposed on the transfer belt.

In the above configuration, it is preferable that the transfer belt includes a first edge extending in the first direction and a second edge opposite to the first edge; and that the first and second image forming units form one of the first and second test patches on the first edge side and the other on the second edge side.

According to the above configuration, the test patch is formed on the transfer belt. Thus, the first and second detection signals are output as the transfer belt runs. One of the first and second test patches is formed on the first edge of the transfer belt and the other is formed on the second edge opposite to the first edge. Therefore, the first and second test patches are properly separated in the second direction.

In the above configuration, the first developer includes a first toner with the first hue, and the first image forming unit includes a first photoconductive drum including a first circumferential surface on which the first image is formed. The first photoconductive drum rotates about a rotational axis along with the second direction. The first image forming unit includes a first developing device configured to supply the first toner to the first photoconductive drum to form the first image on the first circumferential surface. The first developing device preferably successively supplies the first toner along the second direction.

According to the above configuration, the first developer includes the first toner with the first hue. The first image forming unit includes the first photoconductive drum including the first circumferential surface on which the first image is formed. The first photoconductive drum rotates about the rotational axis along with the second direction. The first developing device configured to supply the first toner to the first photoconductive drum to form the first image on the first circumferential surface successively supply the first toner along the second direction. Since the first and second test patches are properly separated in the second direction as described above, the density variation in the second direction resulting from characteristics of the first developing device to successively supply the first toner along the second direction is less likely to affect the bias correction and the γ correction.

In the above configuration, the second developer includes a second toner with the second hue, and the second image forming unit includes a second photoconductive drum including a second circumferential surface on which the second image is formed. The second photoconductive drum rotates about a rotational axis along with the second direction. The second image forming unit includes a second developing device configured to supply the second toner to the second photoconductive drum to form the second image on the second circumferential surface. The second developing device preferably successively supplies the second toner along the second direction.

According to the above configuration, the second developer includes the second toner with the second hue. The second image forming unit includes the second photoconductive drum including the second circumferential surface on which the second image is formed. The second photoconductive drum rotates about the rotational axis along with the second direction. The second developing device configured to supply the second toner to the second photoconductive drum to form the second image on the second circumferential surface successively supplies the second toner along the second direction. Since the second and second test patches are properly separated in the second direction as described above, the density variation in the second direction resulting from characteristics of the second developing device to successively supply the second toner along the second direction is less likely to affect the bias correction and the γ correction.

A method for correcting density of an image according to one aspect of the above embodiment includes a step of generating a test patch on an image bearing member moving in a first direction. The test patch includes a first test patch and a second test patch. This method also includes a step of detecting densities of the first and second test patches, respectively and a step of performing a bias correction and a γ correction based on a comparison between the density of the first test patch and that of the second test patch, wherein the step of generating the test patch includes a step of generating the first and second test patches at positions separated in a second direction intersecting with the first direction.

According to the above method, the respective densities of the first and second test patches formed on the image bearing member moving in the first direction are detected and compared. Based on a comparison result, the bias correction and the γ correction are performed. The first and second test patches are generated at the positions separated in the second direction intersecting with the first direction. Thus, the bias correction and the γ correction are less susceptive to the density variation in the second direction even if it is caused, because of the adjustment based on the comparison result.

In the above configuration, if a difference between the density of the first test patch and a target value determined for the density of the test patch is larger than a difference between the density of the second test patch and the target value, the step of performing the bias correction and the γ correction preferably includes a step of performing the bias correction for an image forming unit configured to generate the first and second test patches based on the density of the first test patch so as to reduce the difference between the first test patch and the target value; a step of causing the image forming unit after the bias correction to form a new second test patch; a step of detecting density of the new second test patch; and a step of performing the γ correction for the image forming unit based on the density of the new second test patch so as to reduce density mottle of the new second test patch.

According to the above configuration, the bias correction is performed for the image forming unit based on the density of the first test patch so as to reduce the difference between the density of the first test patch and the target value. The image forming unit after the bias correction forms the new second test patch. The density of the new second test patch is detected. The γ correction is performed for the image forming unit so as to reduce the density mottle of the new second test patch. The γ correction is properly performed because it is based on the density of the new second test patch.

In the above configuration, if a difference between the density of the first test patch and a target value determined for the density of the test patch is smaller than a difference between the density of the second test patch and the target value, the step of performing the bias correction and the γ correction preferably includes a step of performing the bias correction for an image forming unit configured to generate the first and second test patches based on the density of the second test patch so as to reduce the difference between the second test patch and the target value; a step of causing the image forming unit after the bias correction to form a new first test patch; a step of detecting density of the new first test patch; and a step of performing the γ correction for the image forming unit based on the density of the new first test patch so as to reduce density mottle of the new first test patch.

According to the above configuration, the bias correction is performed for the image forming unit based on the density of the second test patch so as to reduce the difference between the density of the second test patch and the target value. The image forming unit after the bias correction forms the new first test patch. The density of the new first test patch is detected. The γ correction is performed for the image forming unit so as to reduce the density mottle of the new first test patch. The γ correction is properly performed since it is based on the density of the new first test patch.

As this invention may be embodied in several forms without departing from the spirit of essential characteristics thereof, the present embodiment is therefore illustrative and not restrictive, since the scope of the invention is defined by the appended claims rather than by the description preceding them, and all changes that fall within metes and bounds of the claims, or equivalence of such metes and bounds are therefore intended to be embraced by the claims.

This application is based on Japanese Patent application serial No. 2009-183601 filed in Japan Patent Office on Aug. 6, 2009, the contents of which are hereby incorporated by reference.

Although the present invention has been fully described by way of example with reference to the accompanying drawings, it is to be understood that various changes and modifications will be apparent to those skilled in the art. Therefore, unless otherwise such changes and modifications depart from the scope of the present invention hereinafter defined, they should be construed as being included therein.

What is claimed is:

1. An image forming apparatus with a correction function for correcting density of an image, comprising:

an image bearing member configured to convey the image in a first direction while bearing the image; and a controller configured to perform a bias correction and a γ correction for the density, wherein:

the controller includes:

a test patch generator configured to generate a test patch on the image bearing member, the test patch including a first test patch and a second test patch;

a first density sensor configured to detect density of the first test patch to output a first detection signal corresponding to the density of the first test patch;

a second density sensor configured to detect density of the second test patch to output a second detection signal corresponding to the density of the second test patch;

a selector configured to compare the first detection signal with the second detection signal to select one of the first detection signal and the second detection signal as a bias-correction detection signal used for the bias correction while selecting another detection signal as a γ-correction detection signal used for the γ correction; and an adjuster configured to adjust the density by performing the bias correction based on the one detection signal and the γ correction based on the other detection signal, and the image bearing member bears the first and second test patches at positions separated in a second direction intersecting with the first direction.

2. The image forming apparatus according to claim 1, wherein:

the controller performs the bias correction based on a target value determined for density of the test patch; and the selector selects the first detection signal as the one detection signal when a difference between the density of the first test patch and the target value is larger than a difference between the density of the second test patch and the target value while selecting the second detection signal as the one detection signal when the difference between the density of the first test patch and the target value is smaller than the difference between the density of the second test patch and the target value.

3. The image forming apparatus according to claim 1, wherein:

the controller performs the bias correction based on a target value determined for density of the test patch; and the selector selects the second detection signal as the other detection signal when a difference between the density of the first test patch and the target value is larger than a difference between the density of the second test patch and the target value while selecting the first detection signal as the other detection signal when the difference between the density of the first test patch and the target value is smaller than the difference between the density of the second test patch and the target value.

4. The image forming apparatus according to claim 2, wherein the test patch generator causes the image bearing member to bear the first test patch before the second test patch if the selector selects the first detection signal as the one detection signal.

5. The image forming apparatus according to claim 2, wherein the test patch generator causes the image bearing member to bear the second test patch before the first test patch if the selector selects the second detection signal as the one detection signal.

6. The image forming apparatus according to claim 4, further comprising an image forming unit configured to form the image, wherein:

the image bearing member includes a transfer belt to which the image is transferred from the image forming unit;

the selector performs the bias correction for the image forming unit based on the first detection signal so as to reduce the difference between the target value and the density of the first test patch;

the test patch generator causes the image forming unit after the bias correction to form a new second test patch on the transfer belt;

the second density sensor outputs a new second detection signal based on density of the new second test patch; and the adjuster performs the γ correction based on the new second detection signal so as to reduce density mottle.

7. The image forming apparatus according to claim 5, further comprising an image forming unit configured to form the image, wherein:

the image bearing member includes a transfer belt to which the image is transferred from the image forming unit;

the selector performs the bias correction for the image forming unit based on the second detection signal so as to reduce the difference between the target value and the density of the second test patch;

the test patch generator causes the image forming unit after the bias correction to form a new first test patch on the transfer belt;

the first density sensor outputs a new first detection signal based on density of the new first test patch; and the adjuster performs the γ correction based on the new first detection signal so as to reduce density mottle.

8. The image forming apparatus according to claim 2, further comprising an image forming unit configured to form the image, wherein:

the image includes a first image formed using a first developer with a first hue and a second image formed using a second developer with a second hue;

the image forming unit includes a first image forming unit configured to form the first image and a second image forming unit configured to form the second image;

the image bearing member includes a transfer belt to which the first image is transferred from the first image forming unit and the second image is transferred from the second image forming unit;

the first and second images are superimposed on the transfer belt;

the test patch generator causes the first and second image forming units to form the test patch on the transfer belt;

each of the first and second test patches includes a first hue area formed using the first developer and a second hue area formed using the second developer; and the controller performs the bias correction and the γ correction for densities of the first and second hue areas.

9. The image forming apparatus according to claim 8, wherein:

the transfer belt includes a first edge extending in the first direction and a second edge opposite to the first edge; and the first and second image forming units form one of the first and second test patches on the first edge side and another on the second edge side.

10. The image forming apparatus according to claim 8, wherein:

the first developer includes a first toner with the first hue, and the first image forming unit includes:

a first photoconductive drum including a first circumferential surface on which the first image is formed, the first photoconductive drum rotating about a rotational axis along with the second direction; and a first developing device configured to supply the first toner to the first photoconductive drum to form the first image on the first circumferential surface, the first developing device successively supplying the first toner along the second direction.

11. The image forming apparatus according to claim 8, wherein:

the second developer includes a second toner with the second hue, and the second image forming unit includes:

a second photoconductive drum including a second circumferential surface on which the second image is formed, the second photoconductive drum rotating about a rotational axis along with the second direction; and a second developing device configured to supply the second toner to the second photoconductive drum to form the second image on the second circumferential surface, the second developing device successively supplying the second toner along the second direction.

12. A method for correcting density of an image, comprising:

a step of generating a test patch on an image bearing member configured to move in a first direction, the test patch including a first test patch and a second test patch;

a step of detecting densities of the first and second test patches, respectively; and a step of performing a bias correction and a γ correction based on a comparison between the density of the first test patch and that of the second test patch, wherein the step of generating the test patch includes a step of generating the first and second test patches at positions separated in a second direction intersecting with the first direction.

13. The method according to claim 12, wherein, if a difference between the density of the first test patch and a target value determined for the density of the test patch is larger than a difference between the density of the second test patch and the target value, the step of performing the bias correction and the γ correction includes:

a step of performing the bias correction for an image forming unit configured to generate the first and second test patches based on the density of the first test patch so as to reduce the difference between the density of the first test patch and the target value;

a step of causing the image forming unit after the bias correction to form a new second test patch;

a step of detecting density of the new second test patch; and a step of performing the γ correction for the image forming unit based on the density of the new second test patch so as to reduce density mottle of the new second test patch.

14. The method according to claim 12, wherein, if a difference between the density of the first test patch and a target value determined for density of the test patch is smaller than a difference between the density of the second test patch and the target value, the step of performing the bias correction and the γ correction includes:

a step of performing the bias correction for an image forming unit configured to generate the first and second test patches based on the density of the second test patch so as to reduce the difference between the density of the second test patch and the target value;

a step of causing the image forming unit after the bias correction to form a new first test patch;

a step of detecting density of the new first test patch; and a step of performing the γ correction for the image forming unit based on the density of the new first test patch so as to reduce density mottle of the new first test patch.

* * * * *